US005435299A

United States Patent [19]

Langman

[11] Patent Number: 5,435,299

[45] Date of Patent: Jul. 25, 1995

[54] RESPIRATORY MASK

[76] Inventor: Vaughan A. Langman, Department of Biology, Louisiana State University, 1 University Place, Shreveport, La. 71115

[21] Appl. No.: 81,557

[22] Filed: Jun. 23, 1993

Related U.S. Application Data

[63] Continuation-in-part of Ser. No. 781,098, Oct. 22, 1991, abandoned.

[51] Int. Cl.[6] ..... A62B 18/08

[52] U.S. Cl. ..... 128/201.13; 128/204.17; 128/206.22

[58] Field of Search ..... 128/201.13, 203.26, 128/203.27, 204.13, 204.17, 206.22

[56] References Cited

U.S. PATENT DOCUMENTS

| | | | |
|---|---|---|---|
| 302,949 | 8/1884 | Skene | 128/206.22 |
| 2,435,721 | 2/1948 | Lehmann . | |
| 3,814,094 | 6/1974 | DeAngelis et al. . | |
| 3,881,482 | 5/1975 | Lindholm | 128/201.13 |
| 4,090,513 | 5/1978 | Togawa . | |
| 4,136,691 | 1/1979 | Ebeling et al. | 128/201.13 |
| 4,325,365 | 4/1982 | Barbuto | 128/201.13 |
| 4,458,679 | 7/1984 | Ward | 128/201.13 |
| 4,620,537 | 11/1986 | Brown | 128/201.13 |
| 4,771,770 | 9/1988 | Artemenko et al. | 128/201.13 |
| 4,793,343 | 12/1988 | Cummins, Jr. et al. | 128/204.17 |
| 4,825,863 | 5/1989 | Dittmar et al. | 128/204.17 |
| 4,905,686 | 3/1990 | Adams | 128/204.17 |
| 4,941,467 | 7/1990 | Takata | 128/203.12 |
| 5,035,236 | 7/1991 | Kanegaonkar | 128/201.13 |
| 5,320,096 | 6/1994 | Hans | 128/201.13 |
| 5,357,947 | 10/1994 | Adler | 128/201.13 |
| 5,383,447 | 1/1995 | Lang | 128/201.13 |

*Primary Examiner*—Edgar S. Burr
*Assistant Examiner*—Aaron J. Lewis
*Attorney, Agent, or Firm*—Middleton & Reutlinger; Charles G. Lamb

[57] ABSTRACT

A respiratory mask for use in relatively cold environments configured to fit over the nose and mouth of the wearer. The mask is constructed of an insulating material with a flow-through opening therein in spaced alignment with at least the mouth of the wearer. The flow-through opening is filled with a thermally conductive mesh material wherein all of the fluids flowing into the interior of the mask and all of the fluids flowing out of the mask must flow through said thermally conductive material.

7 Claims, 1 Drawing Sheet

RESPIRATORY MASK

REFERENCE TO RELATED APPLICATIONS

This is a continuation-in-part application of U.S. patent application Ser. No. 07/781,098, filed Oct. 22, 1991 now abandoned.

BACKGROUND OF THE INVENTION

The invention relates generally to respiratory insulating masks, and more particularly to a face mask with means for tempering or otherwise conditioning cold air for breathing. Even more particularly, this invention relates to an artificial temporal counter-current heat exchanger.

In the extreme arid cold, typical of the cold deserts of Alaska inside the Arctic Circle and everywhere that animals are exposed to extreme dry cold conditions, man is at a disadvantage. And the inhalation of cold air (−30° C. to −60° C.) can be detrimental to man's health. In an attempt to work and survive in these conditions man has copied the adaptions of the animals living year around in these habitats by increasing his body insulation by putting on various types of cold weather coats, gloves, hats, pants, etc. However, evolution has given all of the animals living in extreme cold an important adaptation that man has not copied. The animals have not only insulated their bodies from the cold but also insulate their respiratory systems to prevent heat and water loss while respiring cold dry air.

All mammals must heat the air they breathe to body temperature (37° C.) and saturate it with water vapor. In temperate climates this does not represent an energy problem for mammals since the ambient temperatures are close to body temperatures and the absolute humidity of the air can be very high. However, in the extreme cold the ability of air to hold water vapor drops to nearly zero and the difference between the temperature of the inhaled air and body temperature is very high. Ambient air temperatures of −30° C. to −60° C. are not uncommon in Alaska and areas in the Arctic where humans live and work. A human breathing −60° C. air must heat every breath nearly 100° C. and add 47 mg of water vapor to every liter of air respired. This costly investment of heat and water is lost by humans when they exhale in the environment. This metabolic cost can be as high as 2–3 times the resting metabolic rate representing a loss of valuable heat and water. This metabolic and water cost raises the energy and water requirements of humans which may otherwise be well insulated against the cold. These energy costs could be critical to humans which are attempting to survive in an emergency situation or exposed during a long-term work effort.

For example, cold adapted species such as reindeer, wolves, seals and polar bears have evolutionary insulated their respiratory systems to prevent heat and water loss. All vertebrate species exposed to cold deserts have evolved some type of temporal counter-current heat exchanger. By vasoconstricting the surface of specialized nasal passages and bones these cold adapted species inhale cold air and cool these surfaces and then exhale over the same surface reducing the temperature of the exhaled air and saving the heat and water that would be lost to the environments, a loss which would have to be replaced in a hostile environment offering little food and water frozen at the temperature of the environment.

In the prior art there are a number of patents which are known to improve the respiratory breathing of humans. For example, U.S. Pat. No. 4,090,513 teaches the humidification of respired air in hospitalized patients; U.S. Pat. No. 4,136,691 teaches a mask for cooling hot air in hot environments wherein the heat exchange portion of the mask is outside the confines of the mask; U.S. Pat. No. 4,325,365 teaches a respiratory mask for cold environments, but exposes the nose to the cold when in use; U.S. Pat. No. 4,196,728 also teaches a respiratory device that exposes the nose to the cold when in use; and, U.S. Pat. No. 4,458,679 teaches a mask utilizing small pipes therein to introduce air into a cavity prior to reception by the wearer. There were a number of respiratory devices which include battery means for heating up the air prior to respiration and these include U.S. Pat. No. 4,601,287; U.S. Pat. No. 4,620,537; U.S. Pat. No. 4,793,343; and U.S. Pat. No. 4,905,686. U.S. Pat. No. 3,814,094 teaches a respiratory mask which includes a counter current exchanger inside the mask which covers substantially the entire inner surface of the mask; and, a great deal of the counter current exchanger inside the mask is insulated from the outside.

SUMMARY OF THE INVENTION

It is an object of the present invention to provide a cold weather breathing mask that is both compact, and inexpensive. It is another object of the present invention to provide a cold weather breathing mask that preheats incoming air with heat from exhaled air. It is a further object of the present invention to provide a cold weather respirator which permits the user to breath without discomfort or harm even under conditions of extreme cold. It is even a further object of the present invention to provide a mask that cools exhaled air, saving much of the respired heat and water from the wearer and recycling said heat and water during the next inhalation cycle.

More particularly the present invention provides a respirator for use in relatively cold environments comprising: a mask configured to fit over the nose and mouth of a wearer, the mask being constructed of an insulation type material; a flow-through opening in the mask in spaced alignment with at least the mouth of the wearer; the mask including a chamber therein spaced between the nose and mouth of the wearer and said flow-through opening in said mask; a mesh of thermally conductive material substantially filling said flow-through opening; said mesh having an outer periphery, a fresh air inlet, and a fresh air outlet into said chamber, said fresh air inlet and said fresh air outlet being in spaced axial alignment, said outer periphery being circumscribed by said insulation whereby all of the fluids entering and leaving said mask flow through said mesh of thermally conductive material in a substantially longitudinal directional flow; and, means for holding the mask on the wearer.

DETAILED DESCRIPTION OF THE DRAWINGS

Figure 1:
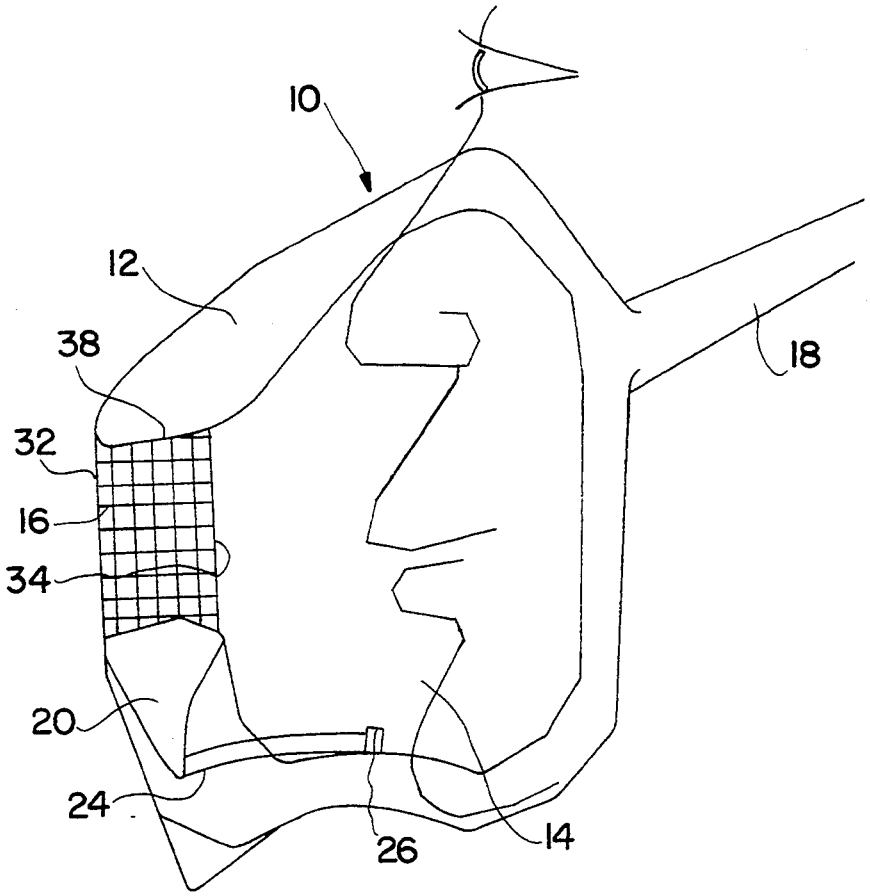
FIG. 1 is a side view of one preferred embodiment of the respiratory mask of the present invention; and, FIG. 2 is a perspective view with a selected portion cut-away of the mask of FIG. 1.

The respiratory mask shown in the Figures is identified by the numeral 10 and comprises a mask portion 12 which is made of an insulation type of material which not only insulates to prevent the transfer of heat therethrough but is also substantially impervious to air. The mask portion 12 may be made of many different types of insulation materials, but preferably are light weight, air impervious materials having a high insulation factor equal to or exceeding 1.25 cm. of foam rubber with a duct tape covering. One particularly useful insulation material is a closed-cell foam made by Uniroyal Corporation and sold under the trademark ENSOLITE.

The mask 10 is configured to cover particularly the mouth and nose of the wearer. In spaced alignment with at least the mouth of the wearer of the mask 10 is a flow-through opening in the mask 10 which is filled with a thermal conducting material 16. The outer periphery of the thermal conducting material 16 is in contact with and circumscribed by insulating material which makes up the mask portion 12. The thermal conductive material 16 retains heat from the outgoing fluids from the wearer and transfers this retained heat to the fresh air coming into the wearer when the mask is used in relatively cold climates. The thermal conducting material 16 is provided with a fresh air inlet 32 in the opening to the environment at one end of the conducting material 16, and a fresh air outlet 34 in the opening to the inside of the mask 10. All of the air entering and leaving the mask 10 must pass through inlet 32 and 34 of this mesh of heat retaining or thermal conducting material 16. In use, incoming and outgoing air flows in a substantially longitudinal directional flow from inlet 32 to outlet 34 for fresh air, and from outlet 34 to inlet 32 for outgoing air. The air flow, even though being in a substantially longitudinal directional flow follows a tortuous path through the mesh 16 thereby providing a high degree of transfer of heat.

The heat retaining material 16 may be any of those known in the art and generally a stainless steel mesh or wool material is a preferred heat retaining material. Preferred heat retaining materials are those with a high specific heat. More particularly, preferred heat retaining materials are those which provide a distance of 0.5 mm. or less between the air stream and the metal thereby insuring turbulent flow and have heat retaining characteristics equal to or greater than 45 grams of 1 mm. wide stainless steel wool mesh. The mesh must be of such woven construction so that the pressure drop of the fluids passing therethrough will be relatively small so that the wearer will not have a problem breathing in the use of the mask of the present invention.

A chamber 14 is also provided in the mask 10 wherein the chamber 14 is disposed between the nose and mouth of the wearer and the thermal conductive material 16. In the chamber 14 the incoming and outgoing fluids are allowed to equilibrate so that the fluids, mostly air, being taken in by the wearer will be heated to a temperature substantially close to the body temperature of the wearer. A preferred opening and therefore thermal conductive material 16 is generally about 3.5 cm. in height, 3 cm. in width, and 20 cm. in length. A moisture trap system for trapping and condensing moisture which is expelled from the respiratory system of the wearer is included in the chamber 14. The moisture trap system is disposed to collect excess water condensing from the thermal conductive material 16 and save said water for re-consumption in emergency situations. The moisture trap system includes a water or moisture container 20 disposed beneath the heat retaining material 16 wherein the moisture in the air condenses and is collected. An outlet conduit 24 in flow communication with the container 20 is provided as the means to remove the moisture that is accumulated in the chamber 20. A valve 26 is also provided at the end of the tube 24 as the means for controlling the flow of water from the container 20.

Figure 2:
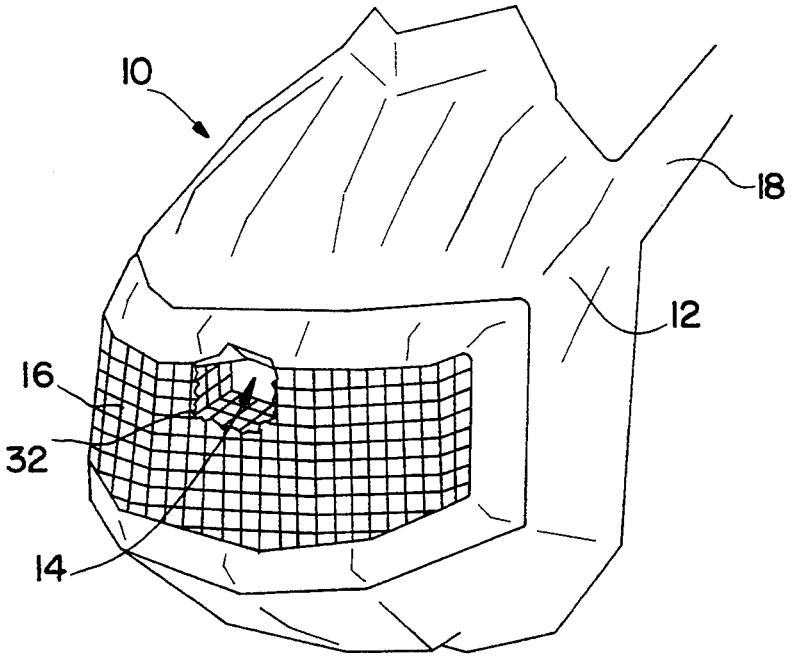

A strap 18 is provided for holding the mask 10 to the face of the wearer. In FIGS. 1 and 2, strap 18 is attached to opposing sides of the mask 10 and includes any well known means (not shown) for adjustment and attachment to the head of the wearer.

The mask of the present invention has been tested in the extreme cold (+35° C.) and shown to cool on inhalation and reduce the temperature of the exhaled air as much as 25° C. Metabolic costs showed that with the mask the metabolic rate of the individual wearer was unchanged from 20° C. to +35° C. As a human breathes, they add water vapor and heat to the elements and during inhalation this water and heat is added to the inspired air. During expiration the now cool material 16, cools the exhaled air and condenses the warm water which will be collected as shown in FIG. 1.

It will be apparent to those skilled in the art that modifications and variations can be made in the respiratory mask of the present invention and therefore the present invention is not limited to the specific details in that all changes and modifications related thereto come within the scope and spirit of the present invention.

What is claimed is:

1. A respiratory mask for use in relatively cold environments comprising:

a mask configured to fit over the nose and mouth of a wearer, said mask being constructed of an insulation material;

a flow-through opening in said mask in spaced alignment with at least the mouth of said wearer;

said mask including a chamber therein spaced between the nose and mouth of said wearer and said flow-though opening;

a mesh of thermally conductive material substantially filling said opening;

said mesh having an outer periphery, a fresh air inlet into said mesh, and a fresh air outlet from said mesh into said chamber, said fresh air inlet and said fresh air outlet being in spaced axial alignment and in substantially parallel planes, said outer periphery being circumscribed by said insulation material whereby all of the fluids entering and leaving said mask flow through said mesh of thermal conductive material in a substantially longitudinal directional flow perpendicular to said parallel planes; and, means for holding said mask on said wearer.

2. The mask of claim 1 wherein said insulation material is a light weight air impervious material.

3. The mask of claim 2 wherein said insulation material is a closed-cell foam.

4. The mask of claim 2 wherein said stainless steel is a stainless steel mesh material.

5. The mask of claim 1 wherein said thermal conductive material is stainless steel.

6. The mask of claim 1 including means to trap condensate condensing in said chamber.

7. The mask of claim 1 wherein said flow-through opening in said mask is also in spaced alignment with the opening in the nose of said wearer.

* * * * *